US010092056B2

(12) United States Patent
Durocher

(10) Patent No.: US 10,092,056 B2
(45) **Date of Patent: *Oct. 9, 2018**

(54) HELMET COMPRISING AN OCCIPITAL ADJUSTMENT MECHANISM

(71) Applicant: BAUER HOCKEY INC., Exeter, NH (US)

(72) Inventor: Jacques Durocher, St-Jerome (CA)

(73) Assignee: BAUER HOCKEY, LLC, Exeter, NH (US)

( * ) Notice: Subject to any disclaimer, the term of this patent is extended or adjusted under 35 U.S.C. 154(b) by 375 days.

This patent is subject to a terminal disclaimer.

(21) Appl. No.: 14/293,371

(22) Filed: Jun. 2, 2014

(65) Prior Publication Data

US 2014/0259315 A1 Sep. 18, 2014

Related U.S. Application Data

(63) Continuation of application No. 12/875,485, filed on Sep. 3, 2010, now Pat. No. 8,739,318.

(51) Int. Cl.
*A42B 3/12* (2006.01)
*A42B 3/08* (2006.01)

(52) U.S. Cl.
CPC ..... *A42B 3/125* (2013.01); *A42B 3/085* (2013.01)

(58) Field of Classification Search
CPC ..... A42B 3/085; A42B 3/125; A42B 3/127
See application file for complete search history.

(56) References Cited

U.S. PATENT DOCUMENTS 3,591,863 A 7/1971 Rickard
3,787,894 A * 1/1974 Goodman, Jr. ..... A42B 3/145 2/418
4,539,715 A 9/1985 Clement
5,042,093 A * 8/1991 Legendre ..... A42B 3/145 2/419
5,572,749 A 11/1996 Ogden
5,815,847 A * 10/1998 Holden, Jr. ..... A42B 3/125 2/414
5,898,950 A 5/1999 Spyrou et al.
6,968,575 B2 11/2005 Durocher
6,981,284 B2 1/2006 Durocher
7,870,618 B2 1/2011 Pilon et al.
7,954,178 B2 6/2011 Durocher et al.
2001/0022005 A1 9/2001 Sasaki et al.
2007/0199136 A1 8/2007 Brine et al.
2010/0050323 A1 3/2010 Durocher et al.
2013/0025032 A1 1/2013 Durocher et al.

FOREIGN PATENT DOCUMENTS

WO 2006/099928 9/2006

OTHER PUBLICATIONS

Search Report dated Apr. 4, 2011 in connection with European Patent Application No. 10175274.9, 6 pages.

* cited by examiner

*Primary Examiner* — Anna Kinsaul

(57) ABSTRACT

A hockey or lacrosse helmet with a rear shell having a central elongated slot extending along a longitudinal axis of the helmet; a rear inner pad for facing the back and left and right side regions of the head, the rear inner pad being mounted to the rear shell; an occipital inner pad located below the rear inner pad for facing the occipital region of the head; and a single wedging member located between the rear shell and the occipital inner pad, the single wedging member being movable along the longitudinal axis of the helmet from a first position to a second position.

25 Claims, 10 Drawing Sheets

HELMET COMPRISING AN OCCIPITAL ADJUSTMENT MECHANISM

CROSS-REFERENCE TO RELATED APPLICATION

This application is a continuation application of U.S. application Ser. No. 12/875,485 filed on Sep. 3, 2010, the contents of which are incorporated herein by reference in their entirety.

FIELD OF THE INVENTION

The present invention relates to a hockey or lacrosse helmet having an occipital adjustment mechanism for improving the fit of the helmet on the head of the player.

BACKGROUND OF THE INVENTION

U.S. Pat. No. 5,898,950 entitled Protective Helmet issued to Spyrou et al. on May 4, 1999. This patent relates to a helmet comprising a protective shell and releasable attachment means having a first front strap, a second front strap, attachment members, a rear strap, a first side strap, a second side strap, a rear plate, a first support strap and a second support strap. The rear strap comprises an outer region, a first lower extension and a second lower extension, the lower extensions providing a means for cradling the head of the player.

U.S. Pat. No. 6,968,575 entitled Hockey Helmet comprising an Occipital Adjustment Mechanism issued to Durocher on Nov. 29, 2005. This patent relates to a hockey helmet for receiving a head of a player, the head having a crown region and an occipital region. The helmet comprises: (a) a front shell facing the crown region of the head; (b) a rear shell facing the left and right side regions, the back region and the occipital region of the head, the rear shell comprising outer and inner surfaces and left and right openings positioned symmetrically about a longitudinal axis of the helmet; (c) a rear inner pad facing the back and left and right side regions of the head, the rear inner pad being affixed to the inner surface of the rear shell; (d) an occipital inner pad located between the rear shell and the occipital region of the head; (e) a central member extending along the longitudinal axis of the helmet, the central member comprising an upper part that is hingedly mounted to the inner surface of the rear shell and a lower part that is mounted to the occipital inner pad, the lower part comprising left and right passages positioned symmetrically about the longitudinal axis of the helmet; and (f) left and right straps passing through the respective left and right passages of the lower part and the respective left and right openings of the rear shell, each strap comprising a first end and a second end, each first end being retained in the helmet, each second end being accessible to the player such that, when the player pulls each second end of the left and right straps, the lower part of the central member is movable from a first position to a second position wherein, in the second position, the occipital inner pad applies pressure upon the occipital region of the head for urging the front shell towards the crown region of the head.

Against this background, there is a need in the industry for a hockey or lacrosse helmet where the player can move a single mechanism for providing a better fitting on the head of the player.

SUMMARY OF THE INVENTION

As embodied and broadly described herein, the present invention provides a helmet for receiving a head of a hockey or lacrosse player, the head having a crown region, left and right side regions, a back region and an occipital region, the helmet comprising: (a) a front shell for facing the crown region of the head; (b) a rear shell for facing the left and right side regions, the back region and the occipital region of the head, the rear shell comprising inner and outer surfaces and an elongated slot extending along a longitudinal axis of the helmet; (c) a rear inner pad for facing the back and left and right side regions of the head, the rear inner pad being mounted to the rear shell; (d) an occipital inner pad located below the rear inner pad for facing the occipital region of the head; (e) a central member extending along the longitudinal axis of the helmet, the central member comprising an upper part hingedly mounted with respect to the rear shell and a lower part mounted to the occipital inner pad; and (f) a single wedging member located between the rear shell and the central member, the single wedging member being movable along the longitudinal axis of the helmet from a first position to a second position wherein, in use, in the second position, the occipital inner pad applies pressure upon the occipital region of the head for urging the front shell towards the crown region of the head.

The present invention also provides a helmet for receiving a head of a hockey or lacrosse player, the head having a crown region, left and right side regions, a back region and an occipital region, the helmet comprising: (a) a front shell for facing the crown region of the head; (b) a rear shell for facing the left and right side regions, the back region and the occipital region of the head, the rear shell comprising inner and outer surfaces and an elongated slot extending along a longitudinal axis of the helmet; (c) a rear inner pad for facing the back and left and right side regions of the head, the rear inner pad being mounted to the rear shell; (d) an occipital inner pad located below the rear inner pad for facing the occipital region of the head; (e) a central member extending along the longitudinal axis of the helmet, the central member comprising an upper part hingedly mounted with respect to the rear shell and a lower part mounted to the occipital inner pad; and (f) a single wedging member located between the rear shell and the central member, the single wedging member being movable along the longitudinal axis of the helmet from a first position to a second position wherein, in use, in the first position, the occipital inner pad applies a first pressure upon the occipital region of the head, and in the second position, the occipital inner pad applies a second pressure upon the occipital region of the head, the second pressure being greater than the first pressure.

This and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of the embodiments of the present invention is provided herein below, by way of example only, with reference to the accompanying drawings, in which.

DETAILED DESCRIPTION OF THE EMBODIMENTS OF THE INVENTION

Figure 1:
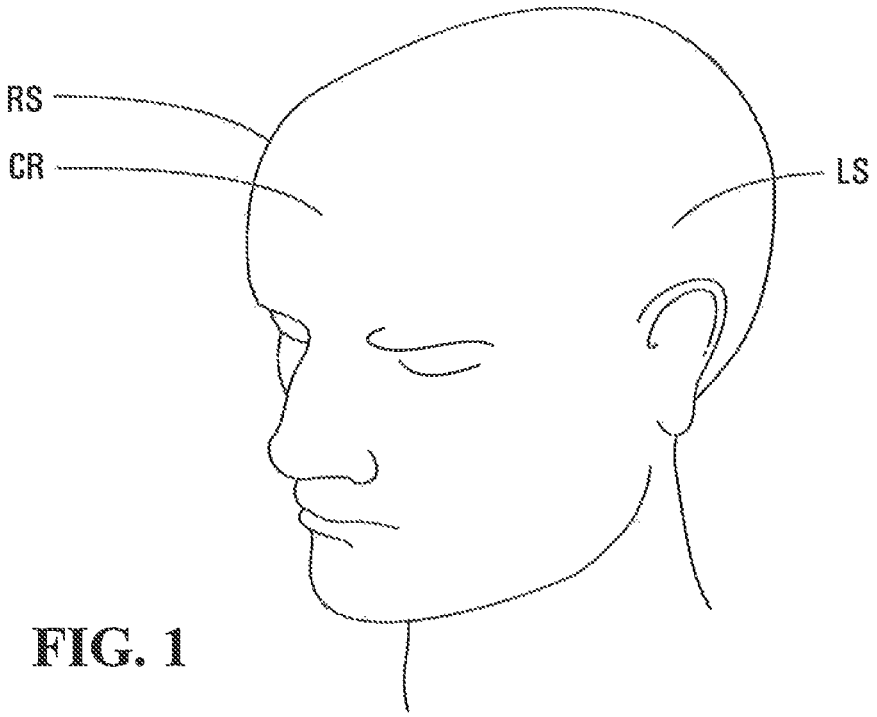
FIG. 1 is a perspective view of a head of a player.

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

Figure 2:
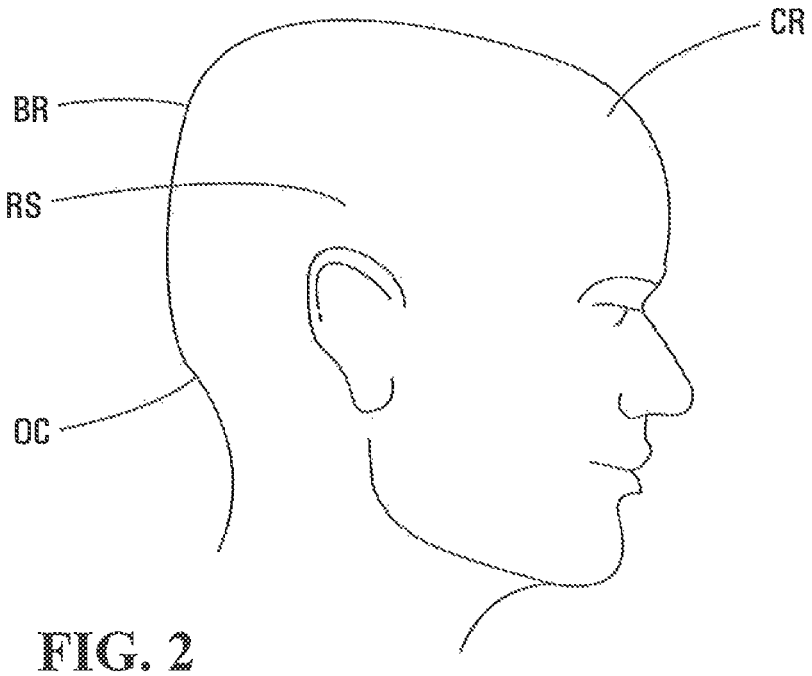
FIG. 2 is a right side elevational view of the head of the player of FIG. 1.

FIGS. 1 and 2 illustrate a head of a hockey or lacrosse player. The head comprises a crown region CR, left and right side regions LS, RS, a back region BR and an occipital region OC. The crown region CR has a front part that substantially corresponds to the forehead and a top part that substantially corresponds to the front top part of the head. In fact, the crown region CR generally corresponds to the frontal bone region of the head. The left and right side regions LS, RS are approximately located above the ears of the player. The occipital region OC substantially corresponds to the region around and under the external occipital protuberance of the head.

Referring to FIGS. 3, 4 and 7A to 8B, a helmet for receiving the head of the hockey or lacrosse player is designated by the reference numeral 10. The helmet 10 comprises a front portion 12 and a rear portion 14 interconnected together. The front and rear portions 12, 14 comprise respective front shell 16 and rear shell 18, the rear shell comprising inner and outer surfaces 20, 22. The front shell 16 and rear shell 18 may be made of a relatively rigid material, such as polyethylene, NYLON, polycarbonate materials, thermoplastics, or thermosetting resins or any other suitable material. The front and rear shells 16, 18 includes a plurality of ventilation apertures 24 that provide the added comfort of allowing air to circulate around the head of the player.

The front shell 16 overlays a front inner pad 26 while the rear shell 18 overlays left and right side inner pads 28, 30 and a rear inner pad 32 having a top projection 34. The front inner pad 26 faces the crown region CR. The rear inner pad 32 faces the back region BR while the left and right side inner pads 28, 30 face the left and right side regions LS, RS. The inner pads 26, 23, 30, 32 may be made of shock absorbing materials such as expanded polypropylene (EPP) or expanded polyethylene (EPE). Other materials can also be used without departing from the spirit of the invention.

The front inner pad 26 has a three-dimensional external configuration that matches the three-dimensional internal configurations of the front shell 16 and is mounted to the front shell 16 by any suitable means such glue, stitches, tacks, staples or rivets. Similarly, the rear inner pad 34 and left and right side inner pads 28, 30 have three-dimensional external configurations that match the three-dimensional internal configurations of the rear shell 18 and are mounted to the rear shell 18 by any suitable means, such as glue, stitches, tacks, staples or rivets.

The helmet 10 may also comprise a front comfort liner affixed on the inner surface of the front inner pad 26 and/or left and right side comfort liners affixed on the inner surface of the respective left and right side inner pads 28, 30. The comfort liners may be made of soft materials such as polyvinyl chloride (PVC). Other materials can also be used without departing from the spirit of the invention. The comfort liners may be affixed on the inner surface of the corresponding inner pads by any suitable means, such as glue or an adhesive layer.

The helmet 10 may comprise left and right ear loops and a chin strap adapted to be attached to ear loops so that when it is secured beneath the chin of the player, the helmet 10 is maintained onto the head of the player. If desired, the helmet 10 may be provided with left and right ear covers for protecting the ears of the player.

The front and rear portions 12, 14 (front and rear shells 16, 18 more particularly) can move one with relation to the other so as to adjust the size of the head receiving cavity of the helmet 10. The helmet may further comprise left and right locking mechanisms for retaining the front and rear portions 12, 14 in the position selected by the player. Any suitable type of locking mechanisms can be used without departing from the spirit of the invention.

In use, a player who puts on the helmet 10 and realizes that it is too large or too small, does not need to remove the helmet 10 to adjust it. The player must simply release the locking mechanism, expand or contract the size of the helmet 10 by displacing the front and the rear portions 12, 14 in relation to each other in the appropriate direction, and close the locking mechanism when the internal size of the helmet is adequate.

Alternatively, the helmet 10 may comprise a non-adjustable one-piece shell covering one or more inner pads. In another possible variant, the helmet 10 may comprise separate front and rear portions 12, 14 that are connected to one another in any suitable way but not adjustable one relative to the other.

Figure 3:
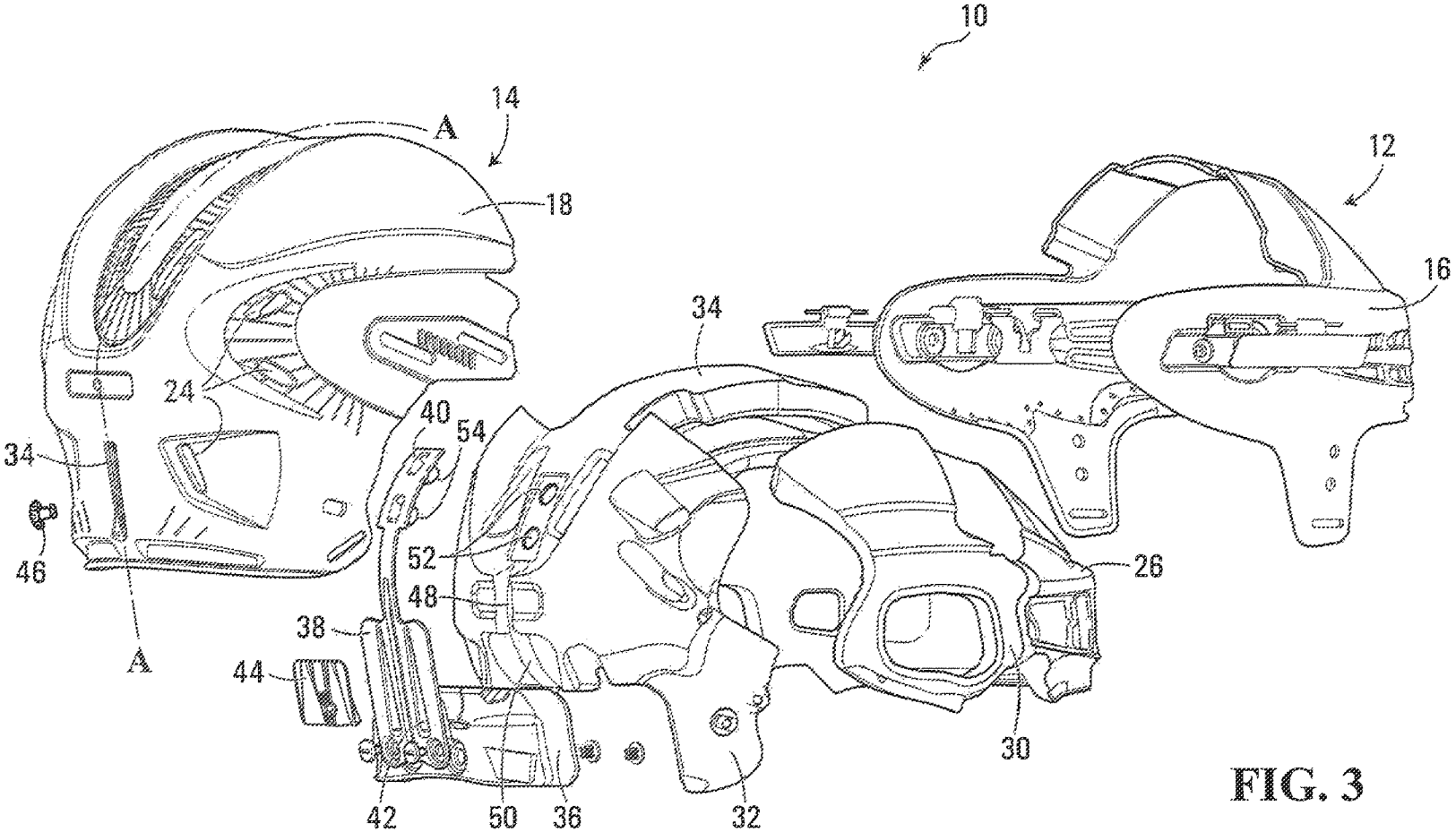
FIG. 3 is a rear perspective exploded view of a helmet constructed in accordance with an embodiment of the invention.
Figure 4:
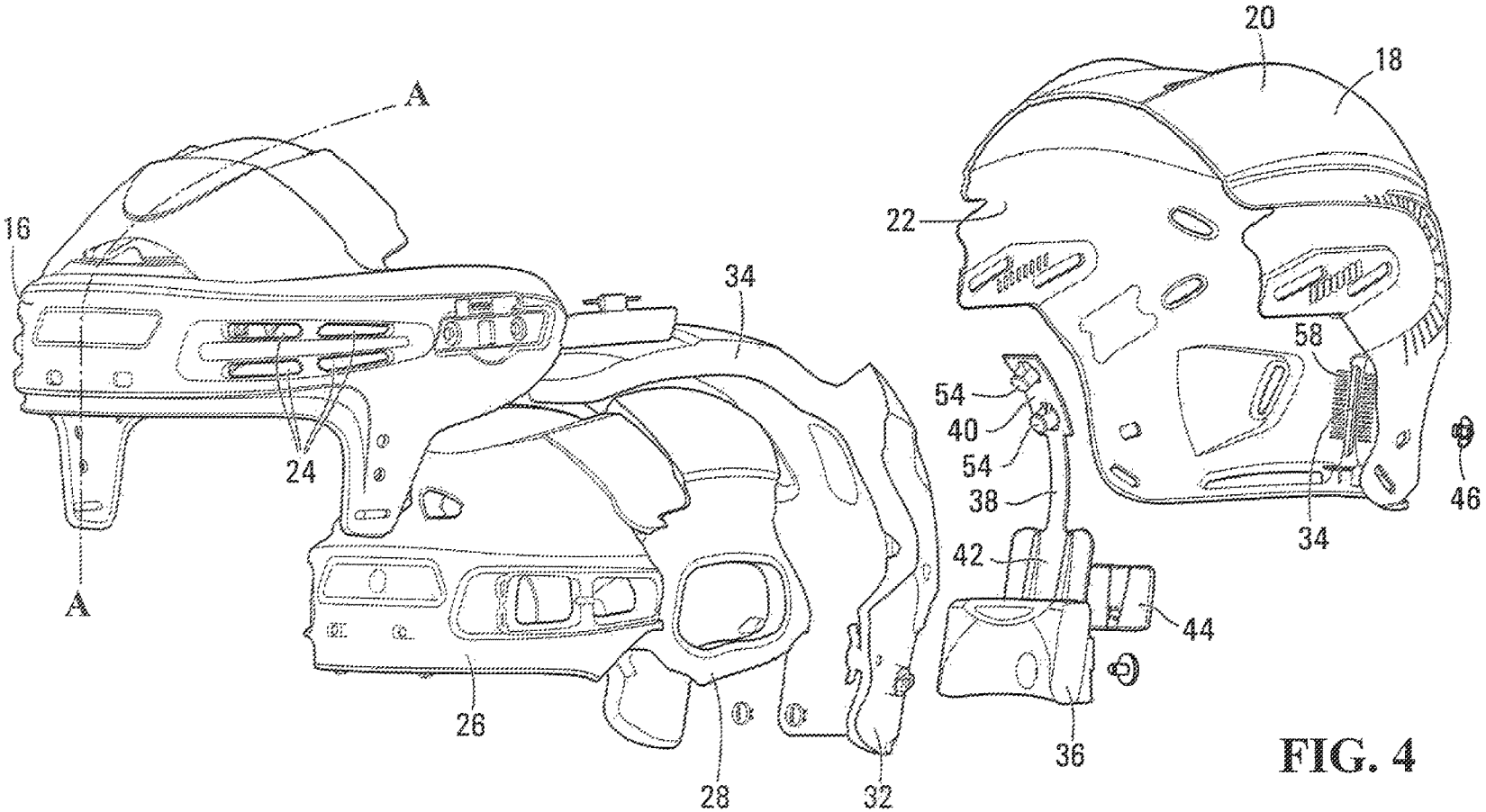
FIG. 4 is a front perspective exploded view of the helmet of FIG. 3.

As best shown in FIGS. 3 and 4, the rear shell 18 comprises an elongated slot 34 extending along the longitudinal axis A-A of the helmet 10. Axis A-A is an imaginary vertical longitudinal plan that bisects the helmet in two generally identical halves as best seen in FIGS. 3 and 4.

Figure 5:
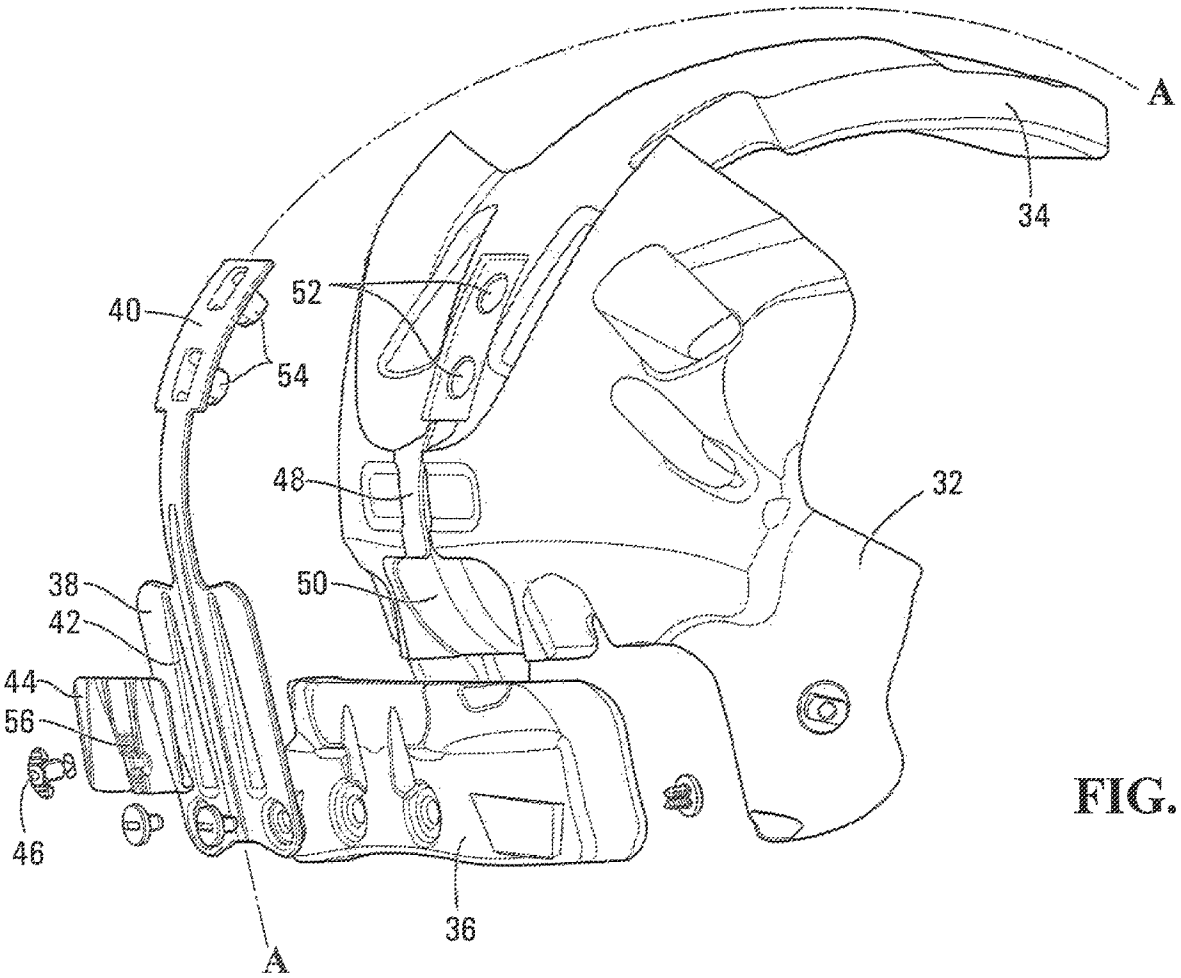
FIG. 5 is a rear perspective exploded view of the occipital adjustment mechanism for the helmet of FIG. 3.
Figure 6:
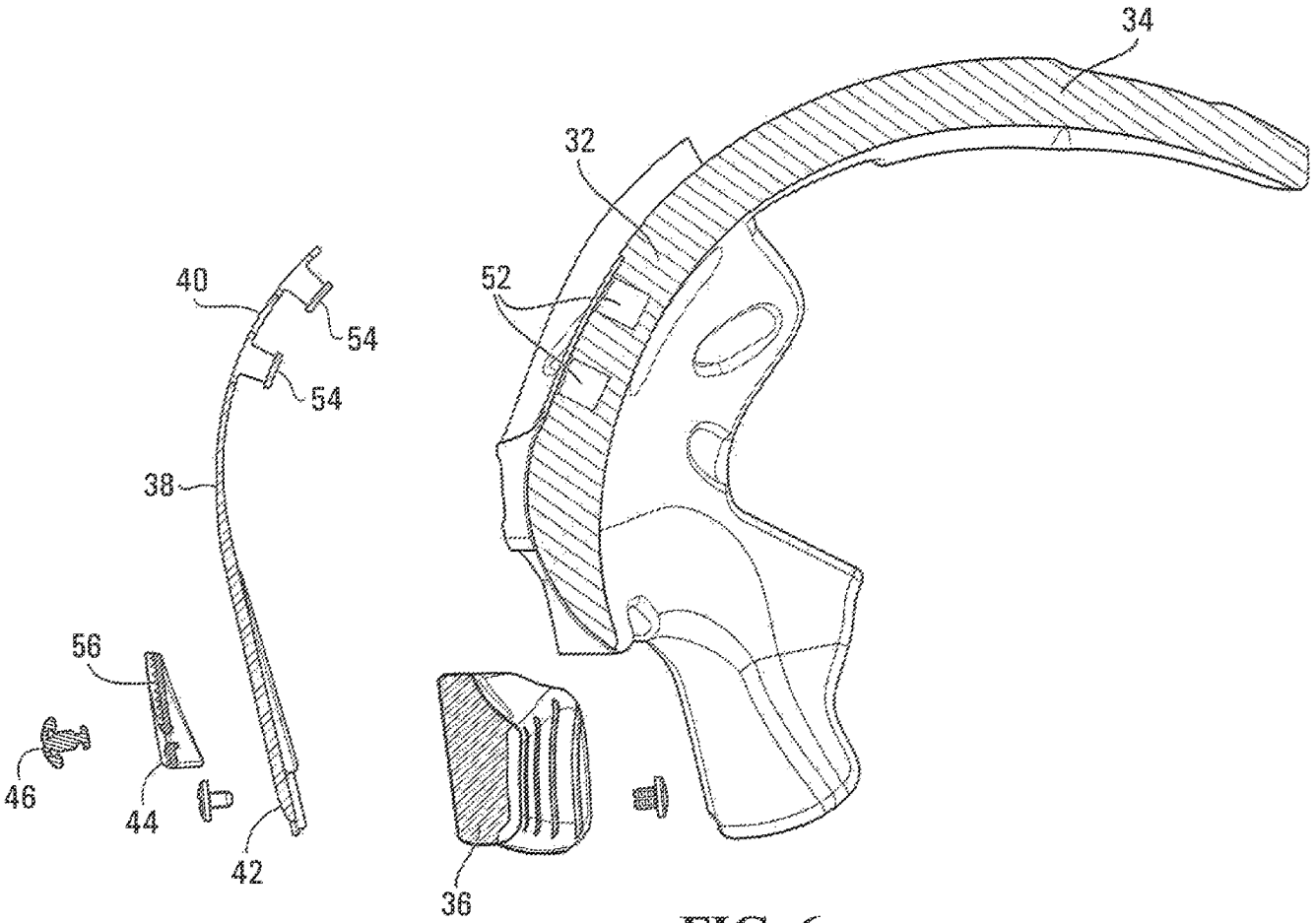
FIG. 6 is a cross-sectional view of the occipital adjustment mechanism of FIG. 5.

FIGS. 5 and 6 show an occipital adjustment mechanism comprising an occipital inner pad 36 for facing the occipital region OC, a central member 38 extending along the longitudinal axis of the helmet 10, the central member 38 comprising an upper part 40 hingedly mounted with respect to the rear shell 18 and a lower part 42 mounted to the occipital inner pad 36, a single wedging member 44 located between the rear shell 18 and the central member 38 and a single actuator 46 connected to the single wedging member 44 and being accessible to the player such that, in use, the player can move the single wedging member 44 from a first position to a second position.

The wedging member 44 has a thickness that increases gradually from its top edge up to its bottom edge as best shown in FIG. 6. Because of its increased thickness, the wedging member 44 therefor acts as a wedge wherein vertical upward displacement of the single wedging member 44 between the rear shell 18 and the central member 38 moves the occipital inner pad 36 from its first position, shown in FIGS. 7A and 8A, towards its second position, shown in FIGS. 8A and 8B, wherein the occipital inner pad 36 applies a greater pressure upon the occipital region OC.

Figure 7A:
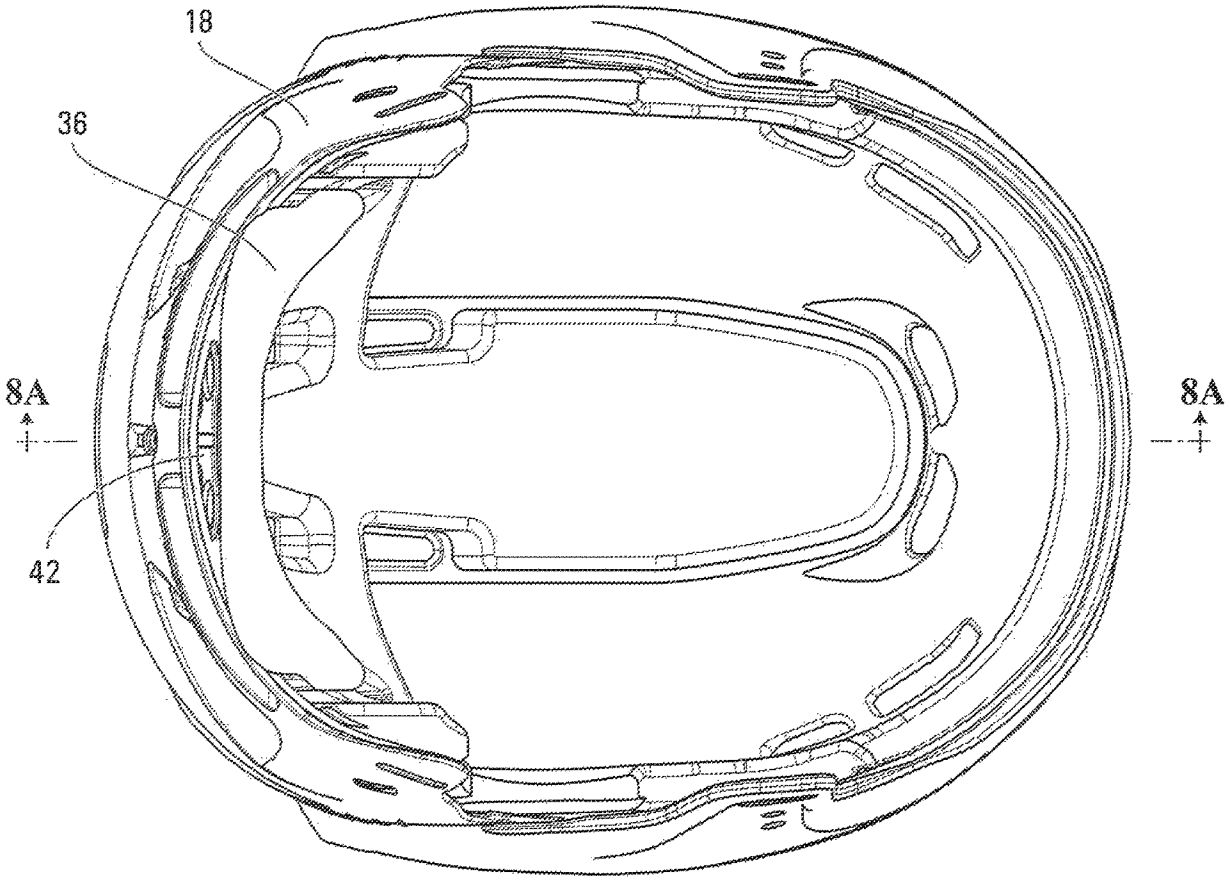
FIG. 7A is a bottom view of the helmet of FIG. 3 with the occipital inner pad shown in a first position.
Figure 7B:
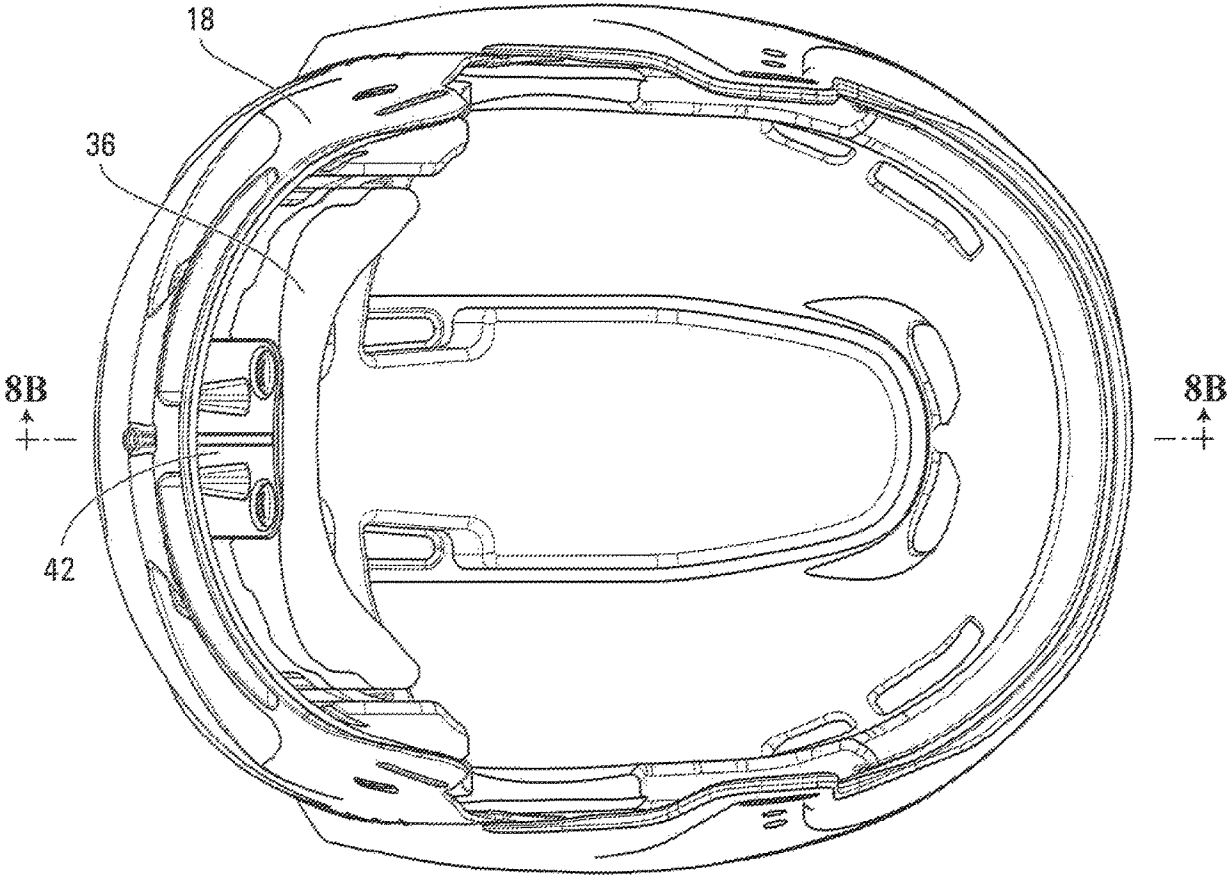
FIG. 7B is a bottom view of the helmet of FIG. 3 with the occipital inner pad shown in a second position.
Figure 8A:
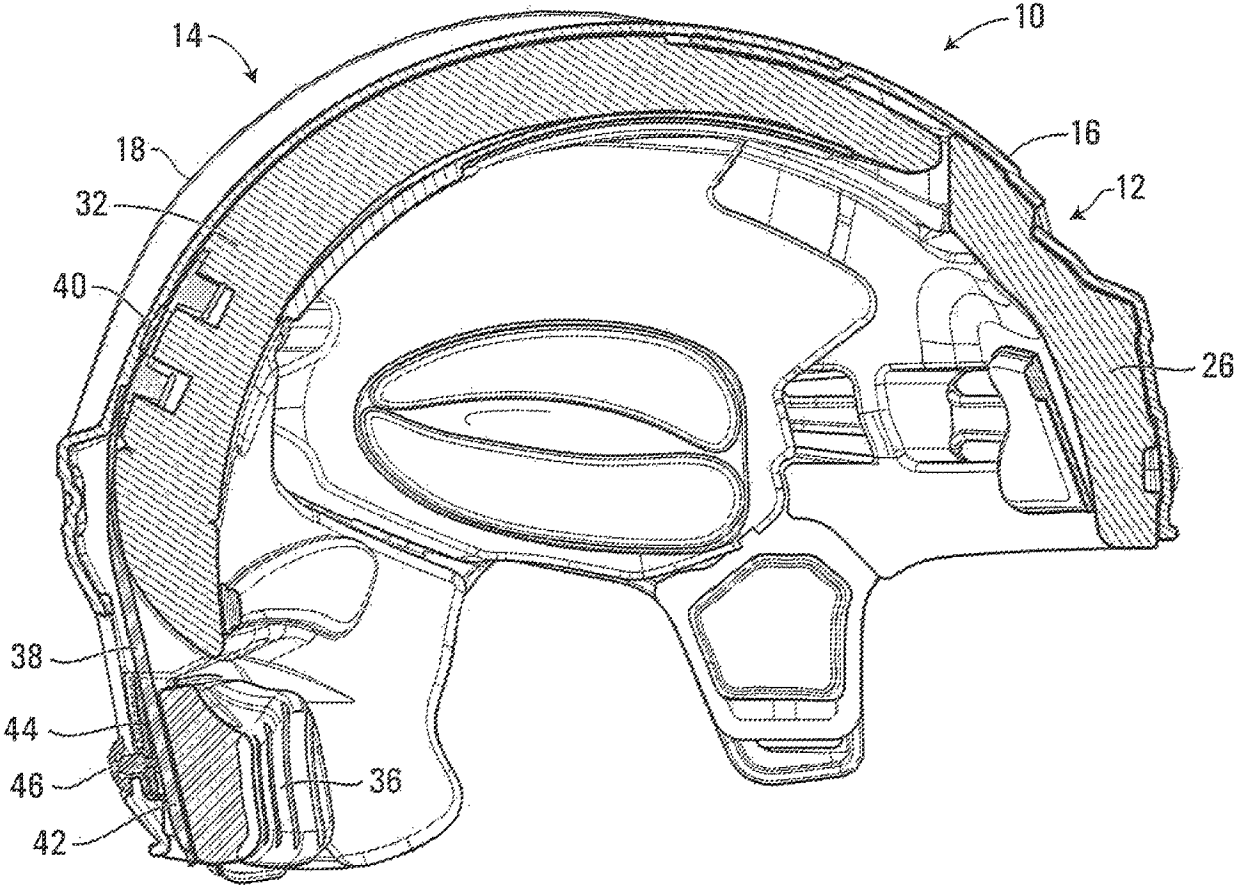
FIG. 8A is a cross-sectional view of the helmet of FIG. 3 taken along line 8A-8A with the occipital inner pad shown in the first position.

As shown in FIGS. 7A and 8A, in the first position, the occipital inner pad 36 applies a first pressure upon the occipital region OC. As shown FIGS. 7B and 8B, in the second position, the occipital inner pad 36 applies a second pressure upon the occipital region OC wherein the second pressure is greater than the first pressure.

Figure 8B:
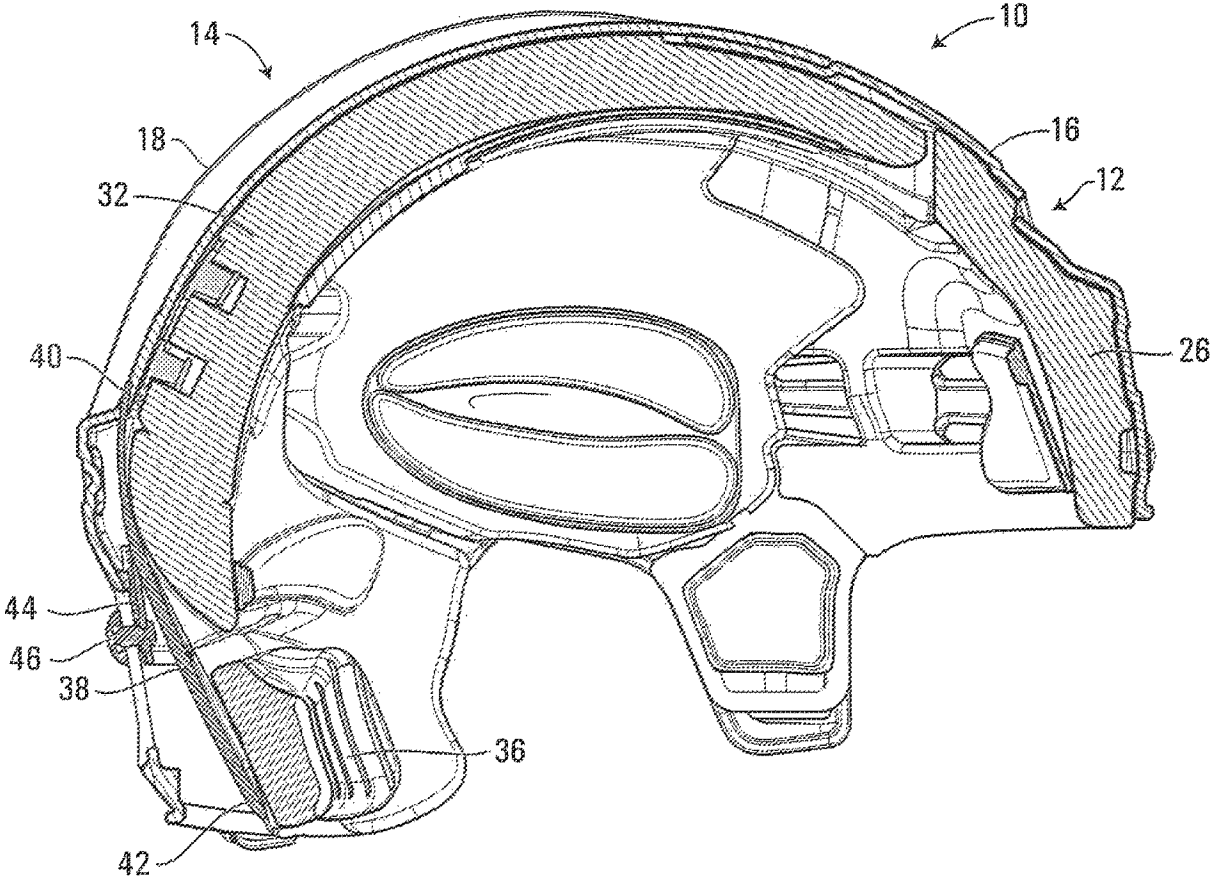
FIG. 8B a cross-sectional view of the helmet of FIG. 3 taken along line 8B-8B with the occipital inner pad shown in the second position.

Hence, the occipital inner pad 36 faces the occipital region OC and is movable between the first position shown in FIGS. 7A and 8A to the second position shown in FIGS. 7B and 8B. In the second position, the occipital inner 36 applies pressure upon the occipital region OC for urging the front portion 12 (the front shell 16 and front inner pad 26) towards the crown region CR (as previously indicated, the crown region CR has a front part that substantially corresponds to the forehead and a top part that substantially corresponds to the front top part of the head).

Depending on how tightly the head of the player fits in the head receiving cavity of the helmet 10, the pressure applied by the occipital inner pad 36 induces a corresponding movement of the helmet 10 towards the back of the head, necessary to seat the front portion 12 of the helmet 10 against the crown region CR.

Also, depending on how tightly the head of the player fits in the head receiving cavity of the helmet 10, in the first position, the occipital inner pad 36 applies a first pressure upon the occipital region OC, and in the second position, the occipital inner pad 36 applies a second pressure upon the occipital region OC, the second pressure being greater than the first pressure.

The occipital inner pad 36 may be made of expanded polypropylene (EPP) or expanded polyethylene (EPE) or polyethylene foam or polyethylene foam having two different densities. Other materials can also be used without departing from the spirit of the invention.

The occipital inner pad 36 may comprise a rear portion and a front portion that is less rigid than the rear portion. For example, the front portion may be made of a soft absorbent material while the rear portion may be made of a rigid plastic-like material or equivalent. One or more comfort liners may be affixed to the inner surface of the occipital inner pad 36.

As best shown in FIG. 5, the central member 38 is an elongated piece extending along the longitudinal axis A-A of the helmet 10 from the upper part 40 to the lower part 42.

The upper part 40 is hingedly mounted with respect to the rear shell 18 (e.g. to the rear inner pad 32 as best shown in FIGS. 8A and 8B); or to the inner surface 20 of the rear shell 18 (now shown)). As shown in FIGS. 3 and 5, the rear inner pad 26 may include a groove 48 and a recessed portion 50 to partially accommodate the central member 38 and the rear inner pad 26. The rear inner pad 26 may also include apertures 52 to receive corresponding pegs 54 provided on the upper part 40 such that the upper part 40 is hingedly mounted to the rear inner pad 24. Hinging may be provided in the central member 38 by any suitable means, and in the example shown, it is provided by the bendability of all the portion of the central member 38 that extends below the upper part 40, and more particularly, the portion of the central member 32 located between the upper and lower parts 40, 42.

The lower part 42 is mounted to the occipital inner pad 36. In one example as shown in FIG. 5, the lower part 42 is screwed to the occipital inner pad 36. Other affixing means (e.g. glue, stitches, rivets, tacks, staples) can be used without departing from the scope of the invention. In another example, the central member may be attached to the occipital inner pad by virtue of being integral, and therefore continuous, with the occipital inner pad. In a further example, the central member may be integrally formed with the rear inner pad at its upper part and integrally formed with the occipital inner pad at its lower part.

Figure 9A:
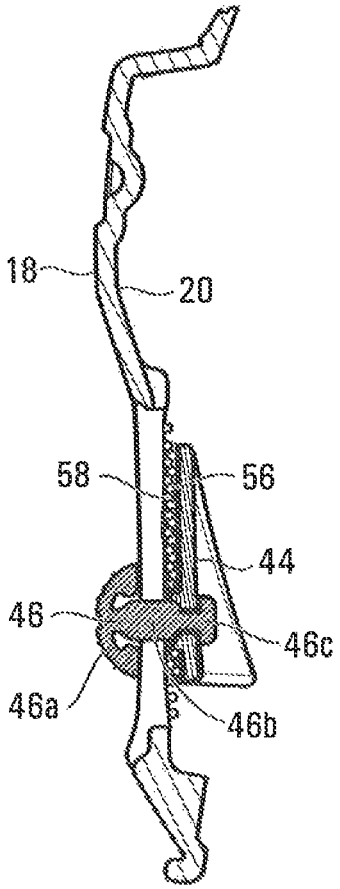
FIG. 9A is an enlarged cross-sectional view of the actuator and wedging member shown in a locked position.
Figure 9B:
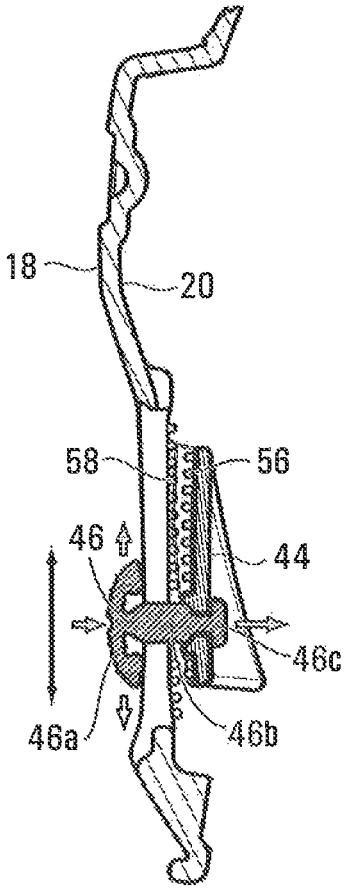
FIG. 9B is an enlarged cross-sectional view of the actuator and wedging member shown in an unlocked position In the drawings, embodiments of the invention are illustrated by way of examples. It is to be expressly understood that the description and drawings are only for the purpose of illustration and are an aid for understanding. They are not intended to be a definition of the limits of the invention.

The single wedging member 44 may comprise a locking mechanism which can be any suitable mechanism for preventing unintentional movement of the single wedging member 44. As shown in FIGS. 9A and 9B, the locking mechanism comprises protrusions 56 provided on the wedging member 44 adapted to register between notches 58 extending from the inner surface 20 of the rear shell 18 and on each side of the elongated slot 34.

FIG. 9A shows the wedging member 44 in a lock position. Here the locking mechanism is engaged and the protrusions 56 register between the notches 58. When the wedging member 44 is in the unlock position, as shown in FIG. 9B, the wedging member 44 is pushed away from the inner surface 20 of the rear shell 18 and the protrusions 56 no longer register between the notches 58 such that movement of the wedging member 44 is possible. Any other frictional engagement is contemplated for the locking mechanism. For example, a rubber friction surface could also be used.

Referring to FIGS. 9A and 9B, the single actuator 46 has a post portion 46*b* extending from a button portion 46*a* through the elongated slot 34, passing through an aperture provided in the wedging member 44 and having a distal end 46*c* with a diameter larger than the one of the wedging member 44 for securing the actuator 46 to the wedging member 44.

The single actuator 46 can be made of a resilient material having a resiliency such that the post portion 46*b* and distal end 46*c* pull the wedging member 44 towards the inner surface 20 of rear shell 18 and holds the wedging member 44 in the lock position. The single actuator 46 can be made of a resilient material such as NYLON™ or polyacetal (DELRIN™) that has the characteristic to return to its original shape when pressure is no longer applied on it. In another example, the actuator may comprise a spring for urging the wedging member 44 in the lock position. Any other suitable biasing means could be used for urging the wedging member 44 in the lock position.

The single actuator 46 may have a length when relaxed that is shorter than the distance required to connect the actuator 46 to the wedging member 44 when the wedging member is in the lock position. As such, the elastomeric material of actuator 46 may be stretched when the wedging member 44 is in the lock position such that a pretension is caused whereby the resilience of the elastomeric material of the actuator 46 pulls the wedging member 44 towards the inner surface 20 of rear shell 18 and holds the wedging member 44 in the lock position.

As shown in FIG. 9B, when the button portion 46*a* is pushed by the player towards the rear shell 18, it is compressed and the post portion 46*b* and distal end 46*c* are pushed away from the inner surface 20 of the rear shell 18, thus disengaging the protrusions 56 from the notches 58 and allowing the wedging member 44 to be moved upwardly or downwardly along the elongated slot 34.

As shown in FIGS. 7A and 7B, the rear shell 18 follows a curvature (in a horizontal plane) while the rear surface of the occipital inner pad 36 extends generally perpendicularly with respect to the longitudinal axis of the helmet 10.

In one embodiment, the rear shell may follow a curvature (in a vertical plane) while the central member may extend along a different curvature when no pressure is applied on it such that the space between the rear shell and central member reduces gradually in an upward direction. Because the space between the inner surface of the rear shell and the central member reduces gradually from the bottom towards the top of the helmet, vertical upward displacement of the single wedging member, which is located in such space, then moves the occipital inner pad towards the second position, wherein the occipital inner pad applies a second pressure upon the occipital region OC that is greater than the first pressure applied upon the occipital region OC when the occipital inner pad is in the first position.

The present invention provides the player of the hockey or lacrosse helmet 10 with an easy and convenient way to adjust the occipital inner pad 36. The single wedging member 44 is moveable via the single actuator 46 to adjust the position of occipital the occipital inner pad 36 while the helmet 10 is being worn. A locking mechanism which may be a series of protrusions provided on the single wedging member 44 that register with corresponding notches or indentations projecting from the inner surface 20 of the rear shell 18 for preventing the unintentional displacement of the single wedging member 44 when the locking mechanism is in the lock position.

The above description of the embodiments should not be interpreted in a limiting manner since other variations, modifications and refinements are possible within the spirit and scope of the present invention. The scope of the invention is defined in the appended claims and their equivalents.

The invention claimed is:

1. A helmet for receiving a head of a hockey or lacrosse player, the head having a crown region, left and right side regions, a back region and an occipital region, the helmet comprising:

a shell comprising a rear portion for facing the back region and occipital region of the head;

a rear inner padded portion disposed within the rear portion of the shell for facing the hack region of the head;

an occipital inner padded portion disposed within the rear portion of the shell and located below the rear inner padded portion for facing the occipital region of the head;

a wedging member located between the rear portion of the shell and the occipital inner padded portion, the wedging member being movable in a direction aligned with an imaginary vertical longitudinal plan that bisects the helmet in two generally symmetrical halves from a first position to a second position, wherein, in use, in the first position, the occipital inner padded portion is configured to apply a first pressure upon the occipital region of the head, and in the second position, the occipital inner padded portion is configured to apply a second pressure upon the occipital region of the head, the second pressure being different from the first pressure; and an actuator connected to the wedging member, the actuator being accessible to the player for moving the wedging member between the first and second positions, wherein the rear portion of the shell comprises an elongated slot extending in the direction aligned with the imaginary vertical longitudinal plan, wherein the actuator is connected to the wedging member through the slot and wherein the first and second positions are located at different positions along the slot.

2. A helmet as defined in claim 1, wherein the actuator comprises a post extending through the elongated slot and wherein the actuator is movable along the elongated slot.

3. A helmet as defined in claim 1, wherein the actuator is movable along the elongated slot, the actuator comprising a button portion that is accessible to the player such that the player can operate the actuator, a post portion extending from the button portion and through the elongated slot and a distal end connecting the actuator to the wedging member.

4. A helmet as defined in claim 3, wherein the wedging member comprises a locking mechanism for preventing the wedging member from moving unintentionally.

5. A helmet as defined in claim 4, wherein the locking mechanism comprises protrusions provided on the wedging member and adapted to register between notches extending from an inner surface of the rear portion of the shell.

6. A helmet as defined in claim 5, wherein the actuator is made of a resilient material such that the actuator returns to its original shape when pressure is no longer applied on the button portion by the player.

7. A helmet as defined in claim 6, wherein upon pressing of the button portion by the player, the button portion is compressed and moves the post portion for disengaging the protrusions such that movement of the wedging member is possible.

8. A helmet as defined in claim 1, wherein the rear portion of the shell has a horizontal curvature and wherein the occipital inner padded portion has a rear surface that is elongated in a horizontal direction of the helmet.

9. A helmet as defined in claim 1, wherein the helmet comprises a central member extending along the vertical direction of the helmet, the central member comprising an upper part hingedly mounted with respect to the rear portion of the shell and a lower part mounted to the occipital inner padded portion, the wedging member being located between the rear portion of the shell and the central member.

10. A helmet as defined in claim 9, wherein the upper part of the central member is mounted to the rear portion of the shell or to the rear inner padded portion.

11. A helmet as defined in claim 9, wherein the central member is integral with either one or both the occipital inner padded portion at its bottom part and the rear inner padded portion at its upper part.

12. A helmet as defined in claim 1, wherein the occipital inner padded portion is made of expanded polypropylene or expanded polyethylene or polyethylene foam.

13. A helmet as defined in claim 1, wherein the occipital inner padded portion is partially made of a soft absorbent material.

14. A helmet as defined in 1, wherein the shell is a one-piece shell.

15. A helmet as defined in claim 1, wherein the shell comprises a front portion for facing the crown region of the head and a front inner padded portion mounted to the front portion of the shell.

16. A helmet as defined in claim 15, wherein the rear portion of the shell is movable relative to the front portion of the shell for allowing size adjustment of the helmet.

17. A helmet as defined in claim 1, wherein the helmet comprises left and right side inner padded portions mounted to the rear portion of the shell.

18. A helmet as defined in claim 1, wherein the second position is closer to a top region of the helmet than the first position and the second pressure is greater than the first pressure.

19. A hockey or lacrosse helmet, the helmet comprising:

a shell;

an occipital padded portion connected to the shell and movable with respect thereto;

a wedging member located between a rear portion of the shell and the occipital padded portion, the wedging member being movable in a direction aligned with an imaginary vertical longitudinal plan that bisects the helmet in two generally symmetrical halves by a user of the helmet from a first position to a second position to push the occipital padded portion towards a front portion of the shell; and an actuator connected to the wedging member, the actuator being accessible to the user for moving the wedging member between the first and second positions, wherein the rear portion of the shell comprises an elongated slot extending in the direction aligned with the imaginary vertical longitudinal plan, wherein the actuator is connected to the wedging member through the slot and wherein the first and second positions are located at different positions along the slot.

20. A helmet as defined in claim 19, wherein the actuator is a single actuator and the slot is a single slot.

21. A helmet as defined in claim 1, wherein the wedging member is configured to wedge the occipital inner padded portion when the wedging member is moved from the first position to the second position such as to cause the occipital inner padded portion to apply the second pressure.

22. A helmet as defined in claim 21, wherein the wedging member has a thickness that gradually increases from a first end to a second end of the wedging member.

23. A helmet as defined in claim 1, wherein the wedging member is linearly movable in the direction aligned with the imaginary vertical longitudinal plan from the first position to the second position.

24. A helmet as defined in claim 19, wherein the wedging member is configured to wedge the occipital padded portion when the wedging member is moved from the first position to the second position such as to push the occipital padded portion towards the front portion of the shell.

25. A helmet as defined in claim 19, wherein the actuator is a single actuator and the slot is a single slot.

* * * * *